US009038604B2

(12) United States Patent
Reiter

(10) Patent No.: US 9,038,604 B2
(45) Date of Patent: May 26, 2015

(54) ELECTROMAGNETICALLY ACTUABLE VALVE

(75) Inventor: Ferdinand Reiter, Markgroeningen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1098 days.

(21) Appl. No.: 12/734,306

(22) PCT Filed: Sep. 22, 2008

(86) PCT No.: PCT/EP2008/062629
§ 371 (c)(1),
(2), (4) Date: Jan. 10, 2011

(87) PCT Pub. No.: WO2009/053191
PCT Pub. Date: Apr. 30, 2009

(65) Prior Publication Data

US 2011/0100332 A1 May 5, 2011

(30) Foreign Application Priority Data

Oct. 24, 2007 (DE) ..... 10 2007 050 817

(51) Int. Cl.
*F02M 61/12* (2006.01)
*F02M 51/06* (2006.01)
*F02M 61/16* (2006.01)

(52) U.S. Cl.
CPC ..... *F02M 61/12* (2013.01); *F02M 51/0682* (2013.01); *F02M 61/166* (2013.01); *F02M 61/168* (2013.01)

(58) Field of Classification Search
CPC ..... F02M 51/0682; F02M 51/06; F02M 2200/9053; F02M 2200/02; F02M 61/08; F02M 61/168; F02M 61/12; F02M 67/12; F02M 69/08
USPC ..... 123/482, 488, 490; 239/585.1; 251/129.01, 129.15
See application file for complete search history.

(56) References Cited

U.S. PATENT DOCUMENTS

| | | | | |
|---|---|---|---|---|
| 5,255,855 | A | 10/1993 | Maier et al. | |
| 6,302,337 | B1 * | 10/2001 | Kimmel | 239/408 |
| 6,484,700 | B1 * | 11/2002 | Kimmel et al. | 123/531 |
| 6,708,906 | B2 * | 3/2004 | Dallmeyer et al. | 239/585.1 |
| 7,204,434 | B2 * | 4/2007 | Pasquali et al. | 239/585.4 |
| 7,946,276 | B2 * | 5/2011 | Pusch et al. | 123/490 |
| 2009/0179090 | A1 * | 7/2009 | Reiter | 239/585.1 |

FOREIGN PATENT DOCUMENTS

| | | |
|---|---|---|
| DE | 41 37 994 | 5/1993 |
| DE | 195 03 820 | 8/1996 |
| DE | 100 51 016 | 4/2002 |
| GB | 2 198 589 | 6/1988 |
| JP | 63-12875 | 5/1988 |
| JP | 9-126058 | 5/1997 |
| JP | 2005-195015 | 7/2005 |

* cited by examiner

*Primary Examiner* — Hai Huynh
*Assistant Examiner* — Gonzalo Laguarda
(74) *Attorney, Agent, or Firm* — Kenyon & Kenyon LLP

(57) ABSTRACT

An electromagnetically actuable valve, e.g., a fuel injector for fuel-injection systems of internal combustion engines, includes an electromagnetically actuable actuating element having a solenoid coil, a fixed core, a valve jacket, and a movable armature for actuating a valve-closure element, which cooperates with a valve-seat surface provided on a valve-seat body. A sleeve-shaped guide element is introduced into an inner longitudinal bore of the armature and into an inner flow bore of the internal pole, the guide element being firmly fixed in place in the armature or the inner pole, and loosely guided in the respective other component.

8 Claims, 3 Drawing Sheets

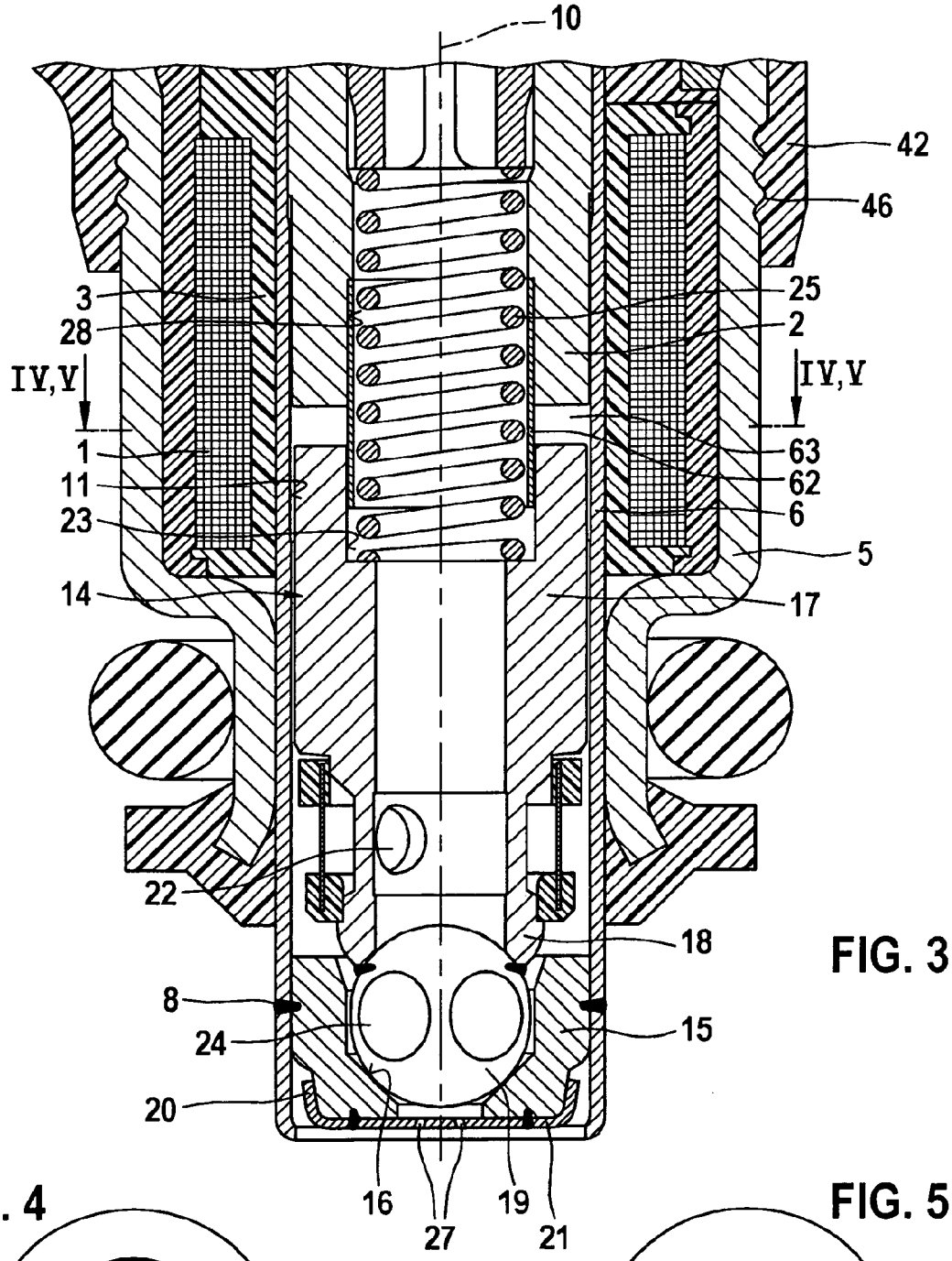
FIG. 3
FIG. 4
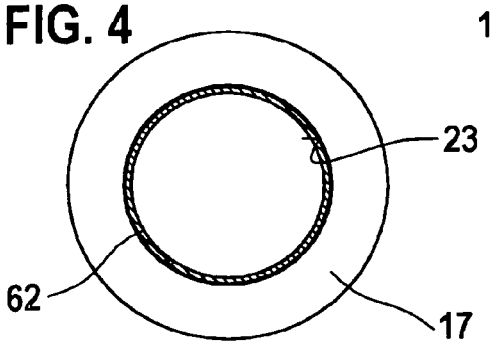
FIG. 5
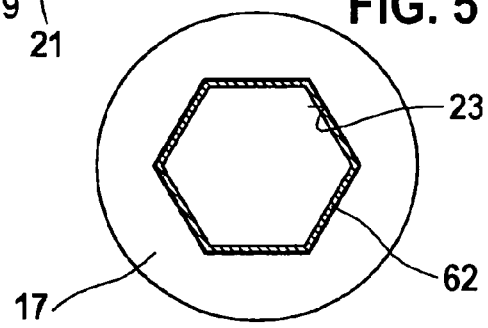

ELECTROMAGNETICALLY ACTUABLE VALVE

BACKGROUND OF THE INVENTION

1. Field of the Invention

The present invention relates to an electromagnetically actuable valve configured as a fuel injector.

2. Description of Related Art

FIGS. 1 and 2 show a known electromagnetically actuable valve in the form of a fuel injector from the related art, which includes a conventional constructive development of a circumferential guide collar at the outer periphery of a movable armature. During its axial movement, the armature with its guide collar slides inside the inner opening of a valve sleeve, along its inner wall, so that the armature is guided within the valve sleeve in this regard, thereby avoiding tilting or canting of the armature.

Additional variants of the guidance of a movable armature of an electromagnetically operated fuel injector are known as well. From published German patent document DE 41 37 994 A1, for example, it can be gathered that an at least partially circumferential guide nose can be impressed into a nozzle support frame, this guide nose likewise providing guidance of the armature at its outer periphery. Furthermore, it is known to impress a plurality of guide noses, distributed across the circumference, in the region of a magnetic restrictor of an elongated valve body, which noses guide the armature during its axial movement (published German patent document DE 195 03 820 A1). From published German patent document DE 100 51 016 A1, a fuel injector is already known, in which guide collar segments are formed at the outer periphery of the armature, which are situated in the region of the greatest radial magnetic flux.

BRIEF SUMMARY OF THE INVENTION

The electromagnetically actuable valve according to the present invention has the advantage of a compact design. The valve is able to be produced in an especially cost-effective manner because the armature guidance is realized in a particularly simple and cost-effective manner. According to the present invention, a guide element is introduced into an inner longitudinal bore of the armature and into an inner flow bore of the internal pole, the guide element being firmly fixed in place inside the armature or the internal pole and loosely guided in the respective other component. The contact surface serving as guide is advantageously reduced in comparison with design approaches known from the related art. The guidance takes place at a smaller diameter level. An improvement is provided in the function insofar as disadvantageous radial forces are avoided as a result of the guide-free outer circumference of the armature.

It is especially advantageous if the guide element is implemented in the form of a sleeve, has thin walls, and is made from a material having an austenitic structure. Especially cost-effective is a guide element in the form of a deep-drawn component. The austenitic material has the advantage that no magnetic short-circuits arise between the internal pole and the armature.

It is advantageous if an anti-rotation fixation is provided, in which functional elements providing an anti-rotation protection are fixed in place on the armature or internal pole and in a corresponding manner on the guide element. The anti-rotation fixation is advantageous with regard to the constancy of functional values of the valve such as the flow rate and jet angle and the wear behavior.

BRIEF DESCRIPTION OF THE SEVERAL VIEWS OF THE DRAWING

FIG. 3 shows a partial view of a valve according to the present invention.

FIG. 4 shows a section along line IV-IV in FIG. 3 with a first variant of an embodiment of the armature.

FIG. 5 shows a section along line V-V in FIG. 3 with a second variant of an embodiment of the armature.

DETAILED DESCRIPTION OF THE INVENTION

Figure 1:
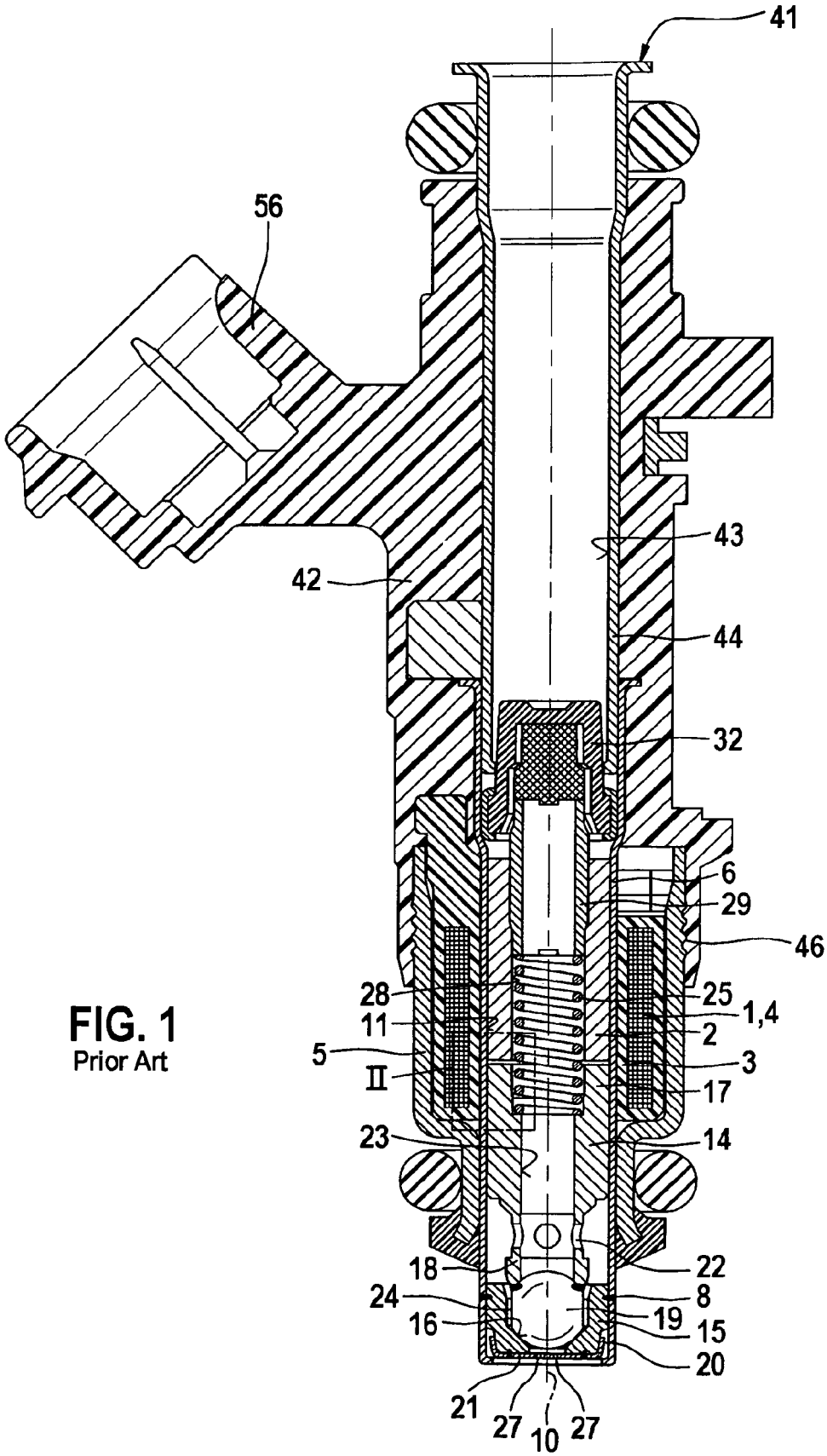
FIG. 1 Prior Art
FIG. 1 shows an electromagnetically actuable valve in the form of a fuel injector according to the related art.

For a better understanding of the present invention, FIG. 1, by way of example, shows an electromagnetically actuable valve in the form of a fuel injector for fuel-injection systems of mixture-compressing internal combustion engines having externally supplied ignition according to the related art.

The valve has a largely tubular core 2, which is surrounded by a solenoid coil 1 and serves as internal pole and partially as fuel passage. In the circumferential direction, solenoid coil 1 is completely surrounded by an external, sleeve-shaped, e.g., ferromagnetic valve jacket 5, which has a stepped design and constitutes an outer magnetic circuit component that serves as external pole. Solenoid coil 1, core 2 and valve jacket 5 jointly form an electrically excitable actuating element.

While solenoid coil 1, which includes a winding 4 and is embedded in a coil shell 3, encloses a valve sleeve 6 on the outside, core 2 is inserted into an inner opening 11 of valve sleeve 6 extending concentrically with respect to a longitudinal valve axis 10. Valve sleeve 6 is elongated and has thin walls. Among other things, opening 11 also serves as guide opening for a valve needle 14, which is axially displaceable along longitudinal valve axis 10. In the axial direction, valve sleeve 6 extends across approximately one half of the total axial extension of the fuel injector, for instance.

In addition to core 2 and valve needle 14, a valve-seat body 15 is also disposed in opening 11, which is fixed in place on valve sleeve 6 with the aid of a welding seam 8, for instance. Valve-seat body 15 has a fixed valve-seat surface 16 as valve seat. Valve needle 14 is formed by, for instance, a tubular armature 17, a likewise tubular needle section 18, and a spherical valve-closure element 19, valve-closure element 19 being permanently joined to needle section 18 by a welding seam, for example. Mounted on the downstream end face of valve-seat body 15 is an apertured spray disk 21 in the shape of a cup, for instance, whose bent and circumferentially extending holding rim 20 is directed in the upward direction, counter to the direction of the flow. The fixed connection of valve-seat body 15 and apertured spray disk 21 is realized by a circumferential and tight welding seam, for example. One or several transverse opening(s) 22 is/are provided in needle section 18 of valve needle 14, so that fuel flowing through armature 17 in an inner longitudinal bore 23 is able to exit and flow past valve-closure element 19, via flattened regions 24, for instance, to valve-seat surface 16.

The fuel injector is actuated electromagnetically, in the known manner. For the axial movement of valve needle 14 and thus for the opening of the fuel injector counter to the spring force of a restoring spring 25 which engages with valve needle 14, or for the closing of the fuel injector, use is made of the electromagnetic circuit having solenoid coil 1, internal core 2, external valve jacket 5, and armature 17. The end of armature 17 facing away from valve-closure element 19 is directed toward core 2. Instead of core 2, a cover part, for instance, which is used as internal pole and closes the magnetic circuit, may be used as well.

Spherical valve-closure element 19 cooperates with valve-seat surface 16 of valve-seat body 15, which tapers frusto-conically in the direction of the flow and is formed downstream from a guide opening in valve-seat body 15 in the axial direction. Apertured spray disk 21 has at least one, e.g., four, spray-discharge orifice(s) 27 formed by eroding, laser drilling or stamping, for example.

Among other things, the insertion depth of core 2 in the fuel injector is decisive for the lift of valve needle 14. When solenoid coil 1 is not energized, one end position of valve needle 14 is defined by the seating of valve-closure element 19 on valve seat surface 16 of valve-seat body 15; when solenoid coil 1 is energized, the other end position of valve needle 14 results from the seating of armature 17 on the downstream core end. The lift is adjusted by axial displacement of core 2, which subsequently is fixedly connected to valve sleeve 6 in accordance with the desired position.

In addition to restoring spring 25, an adjustment element in the form of an adjustment sleeve 29 is inserted into a flow bore 28 of core 2, which extends concentrically with respect to longitudinal valve axis 10 and serves as conduit for the fuel in the direction of valve-seat surface 16. Adjustment sleeve 29 adjusts the initial spring force of restoring spring 25 resting against adjustment sleeve 29, which spring, via its opposite side, in turn is resting against valve needle 14 in the region of armature 17, adjustment sleeve 29 also being used for adjusting the dynamic spray-discharge quantity. A fuel filter 32 is disposed above adjustment sleeve 29 in valve sleeve 6.

The end of the valve on the inflow side is formed by a metal fuel intake nipple 41, which is surrounded by a plastic extrusion coat 42 that stabilizes, protects and surrounds it. A flow bore 43 of a tube 44 of fuel intake nipple 41, which flow bore extends concentrically with respect to longitudinal valve axis 10, acts as fuel inlet. Plastic extrusion coat 42 is injection molded in such a way, for instance, that the plastic directly envelops parts of valve sleeve 6 and of valve jacket 5. A secure seal is achieved via a labyrinth seal 46, for example, at the circumference of valve jacket 5. An electric connector plug 56, which is extrusion-coated at the same time, likewise constitutes part of plastic extrusion coat 42.

Figure 2:
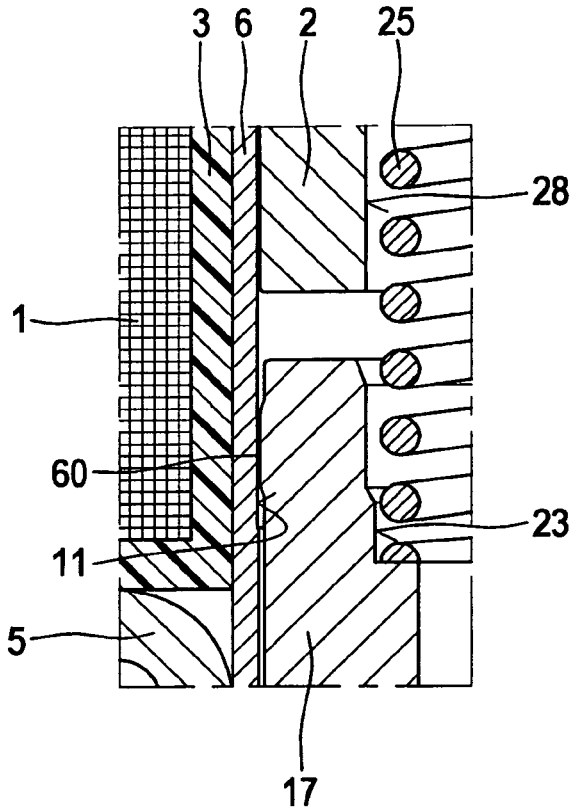
FIG. 2 Prior Art
FIG. 2 shows a partial view II of FIG. 1 of the known fuel injector according to the related art, which characterizes the region relevant for the invention.

FIG. 2 shows a partial view II from FIG. 1 of the fuel injector known from the related art, which characterizes the region relevant for the invention. Especially the guide region of armature 17 is clearly visible. At the outer circumference, movable armature 17 has a circumferential guide collar 60 in the known manner, or a plurality of knob-type or nose-type guide collars 60, distributed across the circumference, for guiding armature 17 inside valve sleeve 6 in a reliable and canting-free manner. In the reverse case, guide collar 60, or guide collars 60, may also be formed on valve sleeve 6, the outer circumference of armature 17 then being realized cylindrically at a constant diameter. Correspondingly, restoring spring 25 has considerable play with respect to the wall of flow bore 28 in core 2, or with respect to the wall of longitudinal bore 23 in armature 17.

FIG. 3 shows a partial view of a valve according to the present invention, in which the guidance of armature 17 is shifted from its outer circumference to the inside, into longitudinal bore 23. According to the present invention, armature 17 is guided through a sleeve-shaped guide element 62 during its axial longitudinal movement. Sleeve-shaped guide element 62 has thin walls and is a deep-drawn component, in particular, due to the cost-effective producibility. In an advantageous manner, guide element 62 is made from a material having an austenitic structure, so that no magnetic short-circuits are produced between core 2 and armature 17. In addition, an austenitic material satisfies the requirement of a material having a high specific electrical resistance so as to avoid Fourcault currents.

Two affixation variants of guide element 62 are conceivable. In a first variant, as shown in FIG. 3, guide element 62 is fixedly installed in flow bore 28 of core 2, while axially movable armature 17 is able to move along guide element 62, which plunges into inner longitudinal bore 23 of armature 17. When solenoid coil 1 is excited, armature 17 is pulled in the direction of core 2, up to its stop face. The lift of valve needle 14 is defined via the size of this working gap 63 to be traversed. When the valve is closed, i.e., when valve closure element 19 is seated on valve seat surface 16, the size of working gap 63 is at its maximum. As a minimum, guide element 62 must be able to plunge into longitudinal bore 23 of armature 17 to this extent, i.e., the available relative movement length of guide element 62 inside longitudinal bore 23 is equal to, or larger than, maximum working gap 63. In this specific development, the fixed bearing is disposed in core 2, the guide, i.e., the floating bearing, is situated in armature 17.

In a second variant, guide element 62 is fixedly installed in longitudinal bore 23 of armature 17, axially movable armature 17 then moving jointly with guide element 62, which plunges into inner flow bore 28 of core 2. When solenoid coil 1 is excited, armature 17 is pulled in the direction of core 2, up to its stop face. When the valve is closed, i.e., when valve closure element 19 is seated on valve seat surface 16, the size of working gap 63 is at its maximum. This is the extent to which guide element 62 must be able to plunge into flow bore 28 of core 2 as a minimum, i.e., the available free movement length of guide element 62 inside flow bore 28 is equal to, or greater than, maximum working gap 63. In this specific development, the fixed bearing is disposed in armature 17; the guide, i.e., the floating bearing, is located in core 2. In both described variants, guide element 62 is fixed in place on the side of the fixed bearing, via a press-fit operation, for instance.

FIG. 4 shows a section along line IV-IV in FIG. 3 with a first development of a variant of armature 17. Sleeve-shaped guide element 62 has a circular design, which plunges into a likewise circular longitudinal bore 23 of armature 17 or is fixed in place inside it.

However, it is also conceivable to provide an anti-rotation fixation in armature 17 or in core 2, which ensures torsion-proof positioning of armature 17 during its axial movement. FIG. 5 shows a section along line V-V in FIG. 3 with a second variant of an embodiment of armature 17, which includes an exemplary anti-rotation fixation. In this case the guide section of guide element 62 is implemented as hex bolt, for example, which plunges into a correspondingly formed longitudinal bore 23 of armature 17. If armature 17 constitutes the fixed bearing side, then the anti-rotation fixation may be provided in core 2 in a comparable manner. As an alternative, the anti-rotation fixation may also be realized by other flattened regions, polygons, recesses or projections, which are formed in corresponding manner on armature 17 or core 2 and on guide element 62. The anti-rotation fixation is generally advantageous for the constancy of functional values of the valve such as flow rate and jet angle and the wear behavior.

What is claimed is:

1. An electromagnetically actuable valve configured as a fuel injector for a fuel-injection system of an internal combustion engine, comprising:

a valve seat body having a valve seat surface;

a valve-closure element configured to cooperate with the valve seat surface;

an excitable actuator configured as an electromagnetic circuit having a solenoid coil, an internal pole, an outer magnetic circuit component, a movable armature configured to actuate the valve-closure element, and a guide element positioned within an inner longitudinal bore of the armature and between the armature and a spring, and within an inner flow bore of the internal pole and between the internal pole and the spring, wherein the guide element is (i) firmly fixed in place in one of the armature or the internal pole, and (ii) movably guided in the other of the armature or the internal pole.

2. The electromagnetically actuable valve as recited in claim 1, wherein the guide element is configured as a sleeve with thin walls.

3. The electromagnetically actuable valve as recited in claim 2, wherein the guide element is made of a material having an austenitic structure.

4. The electromagnetically actuable valve as recited in claim 2, wherein the guide element is firmly fixed in place in the internal pole, and wherein available relative movement length of the guide element in the longitudinal bore of the armature is one of equal to or greater than the maximum working gap between the internal pole and the armature.

5. The electromagnetically actuable valve as recited in claim 2, wherein the guide element is firmly fixed in place in the armature, and wherein available relative movement length of the guide element in the flow bore of the internal pole is one of equal to or greater than the maximum working gap between the internal pole and the armature.

6. The electromagnetically actuable valve as recited in claim 5, wherein the guide element is fixed in place by press-fitting.

7. The electromagnetically actuable valve as recited in claim 2, wherein the guide element has a circular design.

8. The electromagnetically actuable valve as recited in claim 2, wherein an anti-rotation element in the form of a flattened region, polygon, depression or projection is provided on one of the inner longitudinal bore of the armature or inner flow bore of the internal pole, and a corresponding anti-rotation element is provided on the guide element.

* * * * *